US006013312A

United States Patent [19]

Cornell et al.

[11] Patent Number: 6,013,312

[45] Date of Patent: Jan. 11, 2000

[54] COATING APPARATUS

[75] Inventors: Kevin H. Cornell, Rochester, Mich.; W. Craig Huffman, Northbrook, Ill.

[73] Assignee: Henkel Corporation, Gulph Mills, Pa.

[21] Appl. No.: 09/294,352

[22] Filed: Apr. 20, 1999

Related U.S. Application Data

[62] Division of application No. 08/928,510, Sep. 12, 1997.

[51] Int. Cl.[7] ..... B05D 1/00

[52] U.S. Cl. ..... 427/210; 427/211; 427/286; 427/428; 427/429

[58] Field of Search ..... 427/210, 211, 427/286, 428, 429

[56] References Cited

U.S. PATENT DOCUMENTS

| | | | |
|---|---|---|---|
| 4,308,818 | 1/1982 | Abe et al. | 118/211 |
| 4,601,918 | 7/1986 | Zaman et al. | 427/120 |
| 4,604,300 | 8/1986 | Keys et al. | 427/120 |
| 4,609,074 | 9/1986 | Berrend | 184/81 |
| 4,712,507 | 12/1987 | Helling | 118/208 |
| 4,784,584 | 11/1988 | Gruett | 417/399 |
| 4,839,202 | 6/1989 | Grassel et al. | 427/424 |
| 4,995,934 | 2/1991 | Janatka | 156/441.5 |
| 5,253,984 | 10/1993 | Gruett et al. | 417/401 |
| 5,323,653 | 6/1994 | Gruett | 73/326 |
| 5,549,752 | 8/1996 | Hahn et al. | 118/234 |
| 5,638,920 | 6/1997 | Gruett | 184/7.4 |

FOREIGN PATENT DOCUMENTS

| | | |
|---|---|---|
| 1027168 | 4/1958 | Germany . |
| 2004706 | 8/1971 | Germany . |

*Primary Examiner*—Bernard Pianalto
*Attorney, Agent, or Firm*—Ernest G. Szoke; Wayne C. Jaeschke; Lance G. Johnson

[57] ABSTRACT

A coating apparatus is disclosed for applying a coating material on one or more zones of a substrate material. In one embodiment, the coating applicators have fluid-wicking strips that apply the coatings directly to the substrate, while in another embodiment, the fluid-wicking strips indirectly apply the coatings to the substrate via feed rolls. Metering mechanisms supply predetermined amounts of coating material to the fluid-wicking strips. Each coating applicator has a housing with a recess for receiving one the fluid-wicking strips therein. One of the fluid-wicking strips is mounted in each housing which has a plurality of transversely spaced passageways. Each passageway of each applicator housing is fluidly coupled to its own separate air actuated metering mechanism which dispenses coating material to the portion of the fluid-wicking strip adjacent thereto. A desired quantity of coating material is simultaneously delivered via the metering mechanisms to each of the applicator housings. Moreover, each metering mechanism can be individually adjusted to deliver different quantities of coating material to different portions of the fluid-wicking strips.

7 Claims, 7 Drawing Sheets

COATING APPARATUS

This application is a divisional of copending application Ser. No. 08/928,510 filed on Sep. 12, 1997 the disclosure of which is herein incorporated by reference.

FIELD OF THE INVENTION

This invention generally relates to apparatuses for applying a coating material to at least one continuous zone of a substrate, for example, to both sides of a long strip of material. More specifically, the present invention is directed to a coating apparatus having a plurality of metering devices for controlling the amount of coating material being supplied to at least one liquid-wicking solid body, for example, a pair of strips, from which the coating material is transferred, optionally indirectly, to the substrate zone to be coated. The invention will be further described below primarily in connection with use on a long continuous web of substrate material, but it should be understood that it is, *mutatis mutandis*, more widely applicable to other substrates.

BACKGROUND OF THE INVENTION

Currently, numerous methods exist for applying a coating or thin film of material to a sheet or strip of material. One conventional method of coating a continuous strip of sheet material is to submerse the sheet material in a bath of the coating material. This can be accomplished by pulling the sheet material through the bath of coating material, and then wiping off any excess coating material. This method has many drawbacks. One drawback to this method is the difficulty to control the amount of coating material applied to each side of the sheet material. Another drawback is the inability to apply different coating materials to each side of the sheet material. Also, this method often wastes a certain amount of the coating material during the wiping step.

Another method of applying a coating or thin film of material to a sheet or strip of material is to employ a spray coater or atomizer. In such a method, the coating material is electrostatically disposed on the sheet material. A spray coater in accordance with this method is disclosed in U.S. Pat. No. 4,839,202.

Still other types of coating methods include passing the sheet material through various applicators which deposit a thin film onto the sheet material with or without electrostatic assistance. The applicators can be either stationary members or rotatable members. One example of such a coating apparatus, which uses a pair of oppositely disposed applicators, is disclosed in U.S. Pat. No. 5,549,752 to Hahn et al. The Hahn patent discloses passing a continuous strip of material between a pair of oppositely disposed applicators for applying a thin film thereto. In one embodiment, two stationary wicks directly contact the sides of the continuous strip of material to apply a coating to both sides of the sheet material. In another embodiment, the wicks apply the coating material to two feed rolls which contact the sides of the sheet material to apply a thin film of coating material thereto. One drawback to this type of coating apparatus is that it lacks the ability to adjust the amount of coating material being supplied to various sections of the applicators.

Other examples of prior coating apparatuses are disclosed in U.S. Pat. No. 4,601,918 to Zaman et al.; U.S. Pat. No. 4,604,300 to Keys et al.; U.S. Pat. No. 4,712,507 to Helling; and U.S. Pat. No. 4,995,934 to Janatka.

In view of the above, it will be apparent to those skilled in the art that there exists a need for an improved coating apparatus which utilizes a plurality of metering devices to control the flow of coating material to the applicators for obtaining the desired coating on a pair of opposed sides of a substrate or sheet material. This invention addresses this need in the art, along with other needs which will become apparent to those skilled in the art once given this disclosure.

SUMMARY OF THE INVENTION

One object of the present invention is to provide a coating apparatus which utilizes a plurality of metering devices to accurately control the amount of coating material being supplied to the applicators for controlling the amount of coating material being applied throughout the entire area of the zone of the substrate to be coated.

Another object of the present invention is to provide a coating apparatus that is relatively simple to manufacture, assemble and use.

Another object of the present invention is to provide a coating apparatus which can be employed in existing coating operations.

Still another object of the present invention is to provide a coating apparatus which is relatively inexpensive to manufacture.

The foregoing objects are basically attained by providing a coating apparatus for applying a coating material on at least one zone, and often at least two zones, of a substrate material, said apparatus comprising: at least one conveyor for a supply of coating material; at least one fluid-wicking solid body that is in fluid communication with any coating material present in at least said one conveyor therefor and also is in contact with the ambient atmosphere, unless some part of the zone of the substrate to be coated, or of a solid means for transferring coating material to some part of the zone of the substrate to be coated, is in contact with said fluid-wicking solid body; means for causing at least part of the zone of the substrate to be coated to come into contact for at least a part of the time during which the apparatus is used with at least one said fluid-wicking solid body; and a plurality of metering devices each of which is in fluid communication with any supply of coating material that is present in at least one said conveyor therefor and at least a first group of said metering devices being in fluid communication with different portions of the same said fluid-wicking solid body.

Various objects, advantages and salient features of the invention will become apparent from the following detailed description, which, taken in conjunction with the annexed drawings, discloses preferred embodiments of the present invention.

BRIEF DESCRIPTION OF THE DRAWINGS

Referring now to the attached drawings which form part of this original disclosure.

DETAILED DESCRIPTION OF THE PREFERRED EMBODIMENTS

Figure 1:
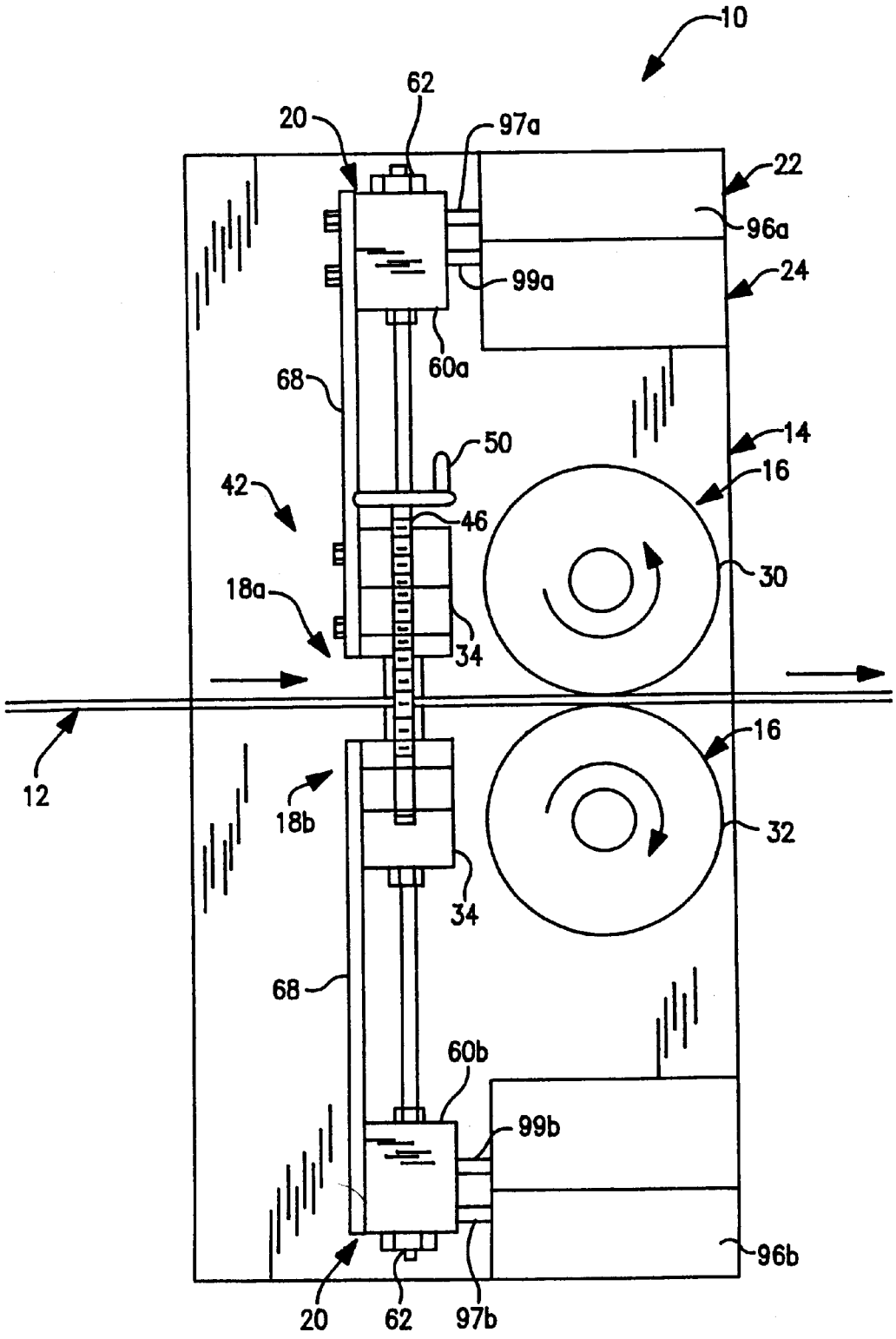
FIG. 1 is a diagrammatic side elevational view of a coating apparatus in accordance with a first embodiment of the present invention with certain parts removed and/or not shown for purposes of illustration.

A preferred embodiment of the invention is specifically adapted to coating both major surfaces of a continuous sheet or web of material by passage through a coating station that is relatively short in comparison to the linear extent of the sheet or web being coated. This embodiment includes means to longitudinally move the sheet material to be coated in a first direction and a pair of coating members. The pair of coating members are designated hereinafter as first and second coating applicators. Each of the first and second coating applicators are fluidly coupled to each of the metering devices in a corresponding first group or a corresponding second group of the metering devices. Each of the first and second groups separately contains a plurality of the metering devices for engaging the sides of the sheet material to apply a first coating thereon. The coating applicators each have a fluid-wicking strip for receiving a metered amount of coating material from the metering devices at spaced locations.

In a first sub-embodiment, the coating applicators have fluid-wicking strips that apply the coatings directly to the substrate, while in a second sub-embodiment, the fluid-wicking strips indirectly apply the coatings to the substrate via feed rolls. The metering mechanisms are used in combination with the fluid-wicking strips to supply predetermined amounts of coating material thereto. Although the description herein refers to the use of air pressure for actuating the metering system, those skilled in the art will understand that any pressurized fluid (e.g., air or liquid) can be used to convey a pressure pulse for actuating the metering mechanisms. The term "fluid" should be read as including pneumatic-based systems as well as hydraulic-based systems.

The coating applicators each have a housing with a recess for receiving one of the fluid-wicking strips therein. One of the fluid-wicking strips is mounted in each of the housings which also has a plurality of spaced passageways, the longest dimension of each such passageway being disposed substantially transverse to the longest dimension of the fluid-wicking strip in the same housing. Each of these transverse passageways of the applicator housings is fluidly coupled to its own separate metering mechanism which dispenses the coating material to the portion of the fluid-wicking strip adjacent thereto.

The metering mechanisms are mounted in a manifold which has a first, usually longitudinally extending, coating passageway for simultaneously supplying the coating material to each of the metering mechanisms. Each manifold also has a second, also usually longitudinally extending, pressurized fluid passageway which connects with each of the metering mechanisms to simultaneously supply pressurized fluid thereto for simultaneously actuating each of the metering mechanisms. A desired quantity of coating material is delivered via the metering mechanisms to each of the associated passageways formed in the applicator housings. Moreover, each metering mechanism can be individually adjusted such that different quantities of coating material can be delivered to different portions of the fluid-wicking strips.

A preferred embodiment of the invention is attained by performing the method of applying a coating material to each side of a substrate, comprising the step of: (1) supplying a first coating material to a plurality of first metering devices; (2) supplying a second coating material to a plurality of second metering devices; (3) metering a predetermined amount of the first coating material from each of the first metering devices; (4) metering a predetermined amount of the second coating material from each of the second metering devices; (5) conveying the predetermined amount of the first coating material from each of the first metering devices to a plurality of spaced apart sections of a first elongated strip of fluid-wicking material such that a film of the first coating material is dispensed therefrom; (6) conveying the predetermined amount of the second coating material from each of the second metering devices to a plurality of spaced apart sections of a second elongated strip of fluid-wicking material such that a film of the second coating material is dispensed therefrom; and (7) passing the substrate between the first and second strips of fluid-wicking material to apply the film of the first coating material to a first side of the substrate and the film of the second coating material to a second side of the substrate which faces in an opposite direction from the first side.

Figure 2:
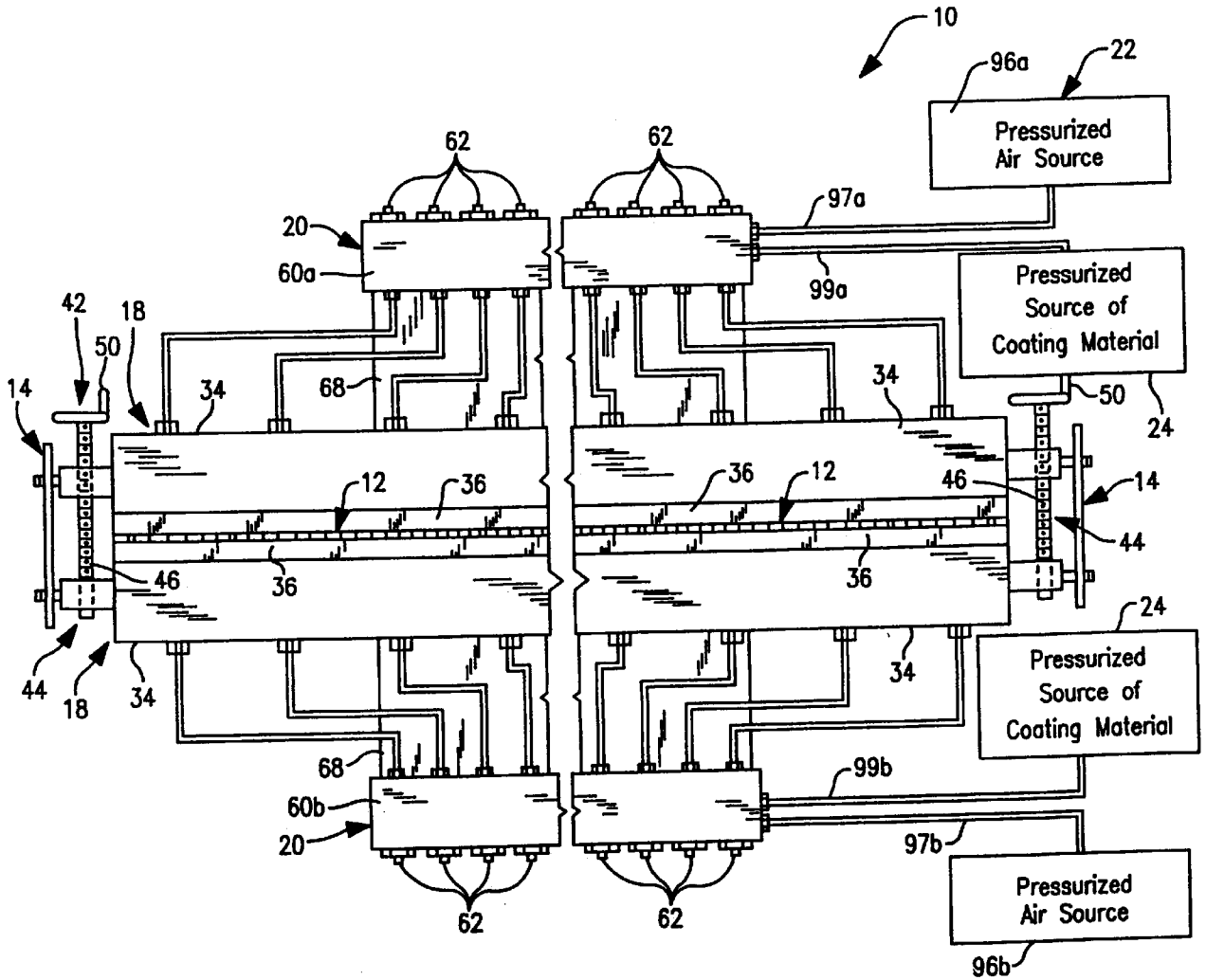
FIG. 2 is a partial, diagrammatic side elevational view of the coating apparatus illustrated in FIG. 1.

Referring initially to FIGS. 1 and 2, a coating apparatus 10 in accordance with a first embodiment of the present invention is diagrammatically illustrated for applying a coating material, such as a lubricating material, to both sides of a substrate 12. In the preferred embodiment, substrate 12 is a continuous strip of sheet material which is continuously fed to coating apparatus 10, and then either rolled up after being coated for later use, or conveyed to the next step of a manufacturing process. For example, coating apparatus 10 can be used in the manufacture of beverage cans. At the beginning of a can forming line, a coil of aluminum sheet is continuously unrolled as a web and fed into coating apparatus 10. A substantially uniform coating of cupper lubricant is applied across the entire width of both the top and bottom sides of the unwinding aluminum sheet 12. The sheet 12 is then cut and formed into a "cup" via conventional equipment (not shown). Accordingly, coating apparatus 10 can form part of the first stage in forming a drawn-and-ironed aluminum beverage can. Coating apparatuses, such as coating apparatus 10, are often used in coating aluminum sheets for constructing cans which are used in the food industry. Of course, coating apparatus 10 can be utilized in a variety of different types of applications.

Coating apparatus 10, as seen in FIGS. 1 and 2, basically includes a support or frame 14 with a sheet feeder 16 coupled thereto, a pair of opposed coating applicators 18*a* and 18*b* for applying a film of coating material to substrate 12, a metering system 20 for controlling the flow of coating material to applicators 18*a* and 18*b*, an operating system 22 for actuating the metering system and a supply or reservoir 24 of coating material to be supplied to the applicators 18*a* and 18*b* via metering system 20.

While the various parts of coating apparatus 10 are diagrammatically illustrated as being mounted on a single frame 14, it will be apparent to those skilled in the art that various components of coating apparatus 10 can be secured to other frames and/or devices as needed and/or desired for the particular application. Accordingly, the use of the term "support" for frame 14 should be construed in this specification and the appended claims as including, but not limited to, a single frame as well as a plurality of frames and/or supporting devices which can be coupled together or separated from each other. In other words, it will be apparent to those skilled in the art from this disclosure that a variety of supports and/or arrangements of the components of the present invention can be employed to carry out the present invention.

Sheet feeder 16 is preferably a pair of feed rolls 30 and 32 which are spaced apart to form a gap therebetween for receiving substrate 12 therein. More specifically, feed rolls 30 and 32 frictionally engage substrate 12 to pull substrate 12 past coating applicators 18*a* and 18*b* in a conventional manner. While feed rolls 30 and 32 are illustrated as pulling substrate 12 past coating applicators 18*a* and 18*b*, it will be apparent to those skilled in the art that feed rolls 30 and 32 can rotate in the opposite direction from that as seen in FIG. 1 so that the substrate 12 is pushed between coating applicators 18*a* and 18*b*. In either case, feed rolls 30 and 32 are preferably driven in a substantially conventional manner, e.g., via a belt drive assembly or a direct drive assembly which are known in the prior art.

Figure 3:
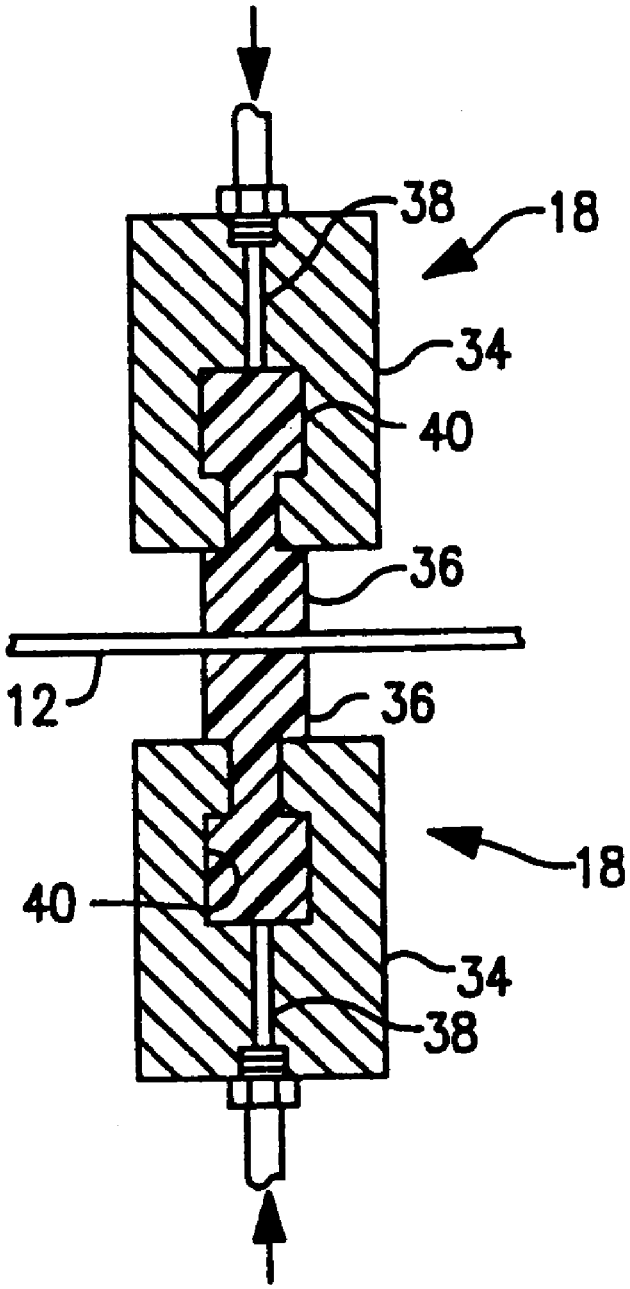
FIG. 3 is an enlarged, cross-sectional view of the upper and lower coating applicators engaged with a substrate as seen along section line 3—3 of FIG. 2.

Upper and lower coating applicators 18*a* and 18*b* are substantially identical in construction, and thus, like reference numerals will be utilized to describe the various components of upper and lower coating applicators 18*a* and 18*b*. As best seen in FIGS. 2 and 3, each coating applicator 18*a* and 18*b* has an elongated applicator housing 34 with an elongated fluid-wicking strip 36 secured thereto.

In particular, applicator housing 34 has a plurality of fluid passageways or bores 38 extending transverse to the longitudinal axis of housing 34 from the outer surface of housing 34 to a longitudinally extending recess 40 formed in the inner surface of housing 34. Recess 40 is designed to hold one of the fluid-wicking strips or felts 36 therein. Fluid-wicking strip 36 receives coating material through passageways 38. Each of the passageways 38 is fluidly coupled to metering system 20 for receiving predetermined amounts of coating material as explained below in more detail. The spacing between passageways 38 depend upon the particular application in which coating apparatus 10 is being used, the material of strips 36 as well as other factors which would be apparent to one skilled in the art in designing a coating apparatus in accordance with the present invention for a particular application.

For example, twelve equally spaced passageways 38 can be formed in each applicator housing 34, with metering system 20 discharging substantially equal volumes of coating material thereto. Each fluid-wicking strip 36 acts as a wick to deliver a substantially uniform film or coating of coating material across the entire width of both the top and bottom sides of substrate or sheet 12. Of course, as explained below, metering system 20 is adjustable such that unequal amounts of coating material can be delivered to passageways 38. This is especially useful in the event that the flow of coating material is interrupted to one of the passageways 38. In particular, if one of the passageways 38 is blocked, the amount of coating material to the two adjacent passageways 38 can be increased to compensate for the loss of coating material from the blocked passageway 38.

Preferably, as seen in FIG. 2, the upper and lower housings 34 are mounted for relative movement on frame 14. For example, lower housing 34 can be fixedly coupled to frame 14, while upper housing 34 can be movably coupled to lower housing 34 to adjust the gap between fluid-wicking strips 36. This permits the operator to adjust the amount of pressure applied to the surfaces of substrate 12 by fluid-wicking strips 36 as needed and/or desired for a particular application. Specifically, an adjustment mechanism 42 is utilized to control the amount of relative movement between upper and lower housings 34.

As seen in FIG. 2, adjustment mechanism 42 is illustrated as including a pair of screw jacks 44, with one of the screw jacks 44 located at each end of applicators 18*a* and 18*b*. Each of the screw jacks 44 has a threaded shaft 46 with its lower end rotatably mounted in a portion of the lower housing 34 and its upper end threadedly secured in a threaded bore of a flange of upper housing 34. Moreover, the upper ends of shafts 46 are provided with a handle or wheel 50 for rotating shaft 46 to cause upper housing 34 to move either towards or away from lower housing 34.

While adjustment mechanism 42 is illustrated as a pair of screw jacks, it will be apparent to those skilled in the art that other types of adjusting mechanisms can be utilized. For example, one or more fluid operated cylinders could be utilized such as one or more air cylinders or hydraulic cylinders. One advantage of utilizing one or more air cylinders is that metering system 20 may be air operated by operating system 22 as discussed below. Thus, operating system 22 could also be utilized to adjust the gap between fluid-wicking strips 36.

Fluid-wicking strips 36 are preferably felt pads which are well-known in the art. Of course, it will be apparent to those skilled in the art that other types of fluid-wicking strips could be utilized. As mentioned above, strips 36 are secured in recesses 40 of applicator housings 34 to receive coating material at a plurality of longitudinally spaced locations. The coating material is wicked from passageways 38 to saturate strips 36 for applying a thin film of coating material to each side of substrate 12. Each of the fluid-wicking strips 36 is preferably a continuous elongated strip to ensure a continuous, uniform film of coating material is applied to each side of substrate 12. Preferably, each strip 36 extends the entire width of the substrate 12 passing between strips 36 such that a thin film of coating material can be applied across the entire width of substrate 12.

Metering system 20, preferably, includes a pair of manifolds 60*a* and 60*b* with a plurality of metering devices 62 mounted in each of the manifolds 60*a* and 60*b*. Preferably, one of the manifolds 60*a* and 60*b* is fixedly coupled to the upper housing 34 of the upper coating applicator 18*a*, while the other or lower manifold 60*b* is fixedly coupled to the lower housing 34 of the lower coating applicator 18*b*.

In the illustrated embodiment, two mounting plates 68 are used to couple upper and lower manifolds 60*a* and 60*b* to upper and lower applicator housings 34, respectively. Of course, it will be apparent to those skilled in the art from this disclosure that a variety of mounting arrangements can be utilized to carry out the present invention. For example, upper and lower manifolds 60*a* and 60*b* can be coupled directly to frame 14 with flexible conduits fluidly coupling the upper and lower metering devices 62 to passageways 38 of upper and lower applicator housings 34.

Upper and lower manifolds 60*a* and 60*b* are preferably substantially identical to each other except for their orientation. In particular, manifolds 60*a* and 60*b* are each preferably constructed by machining an aluminum block. Since upper and lower manifolds 60*a* and 60*b* are substantially identical, the description of the upper manifold 60*a* equally applies to describe the lower manifold 60*b*.

Figure 4:
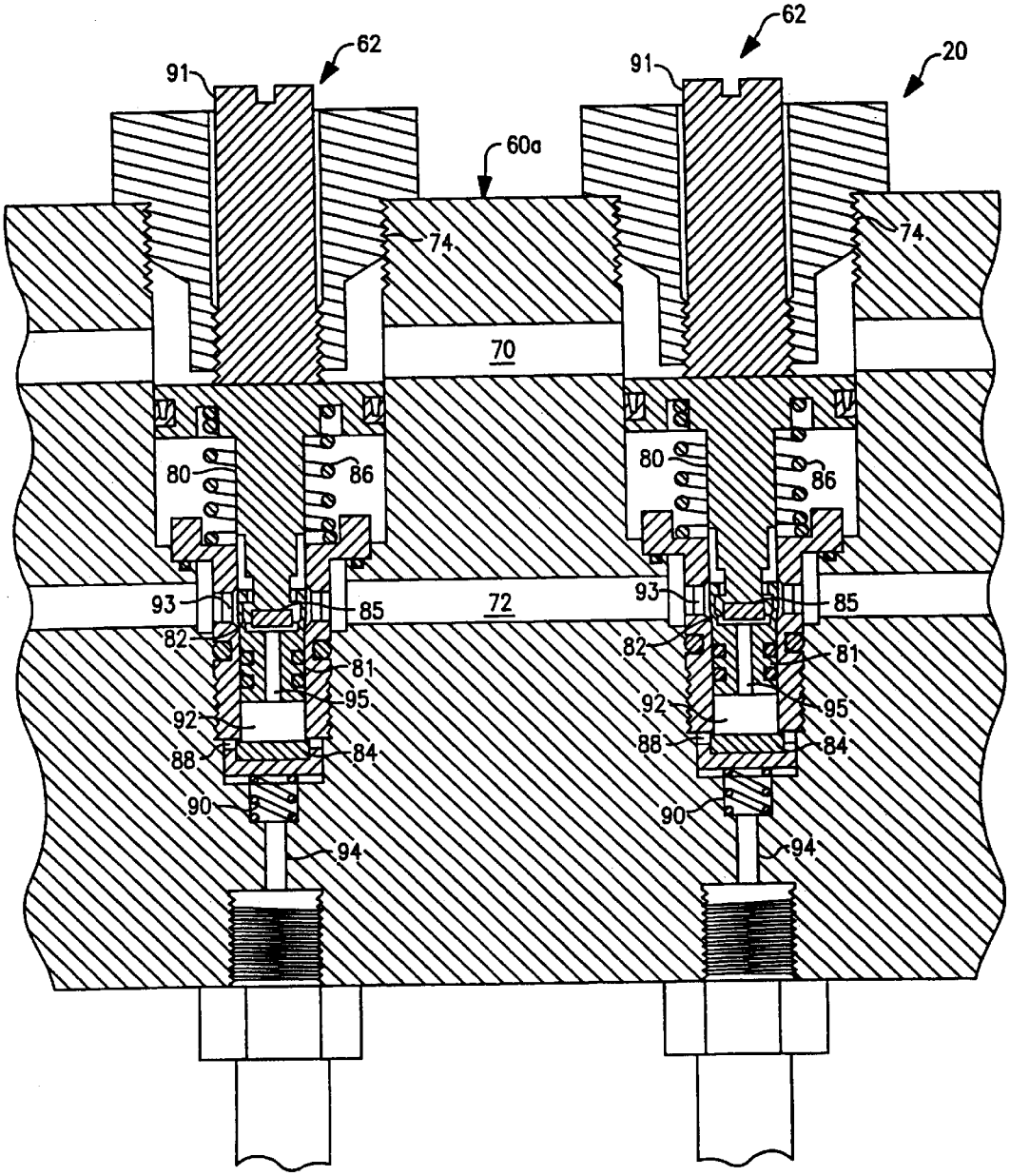
FIG. 4 is a partial cross-sectional view of the upper manifold and a pair of the upper metering devices prior to discharging a predetermined amount of coating material.
Figure 5:
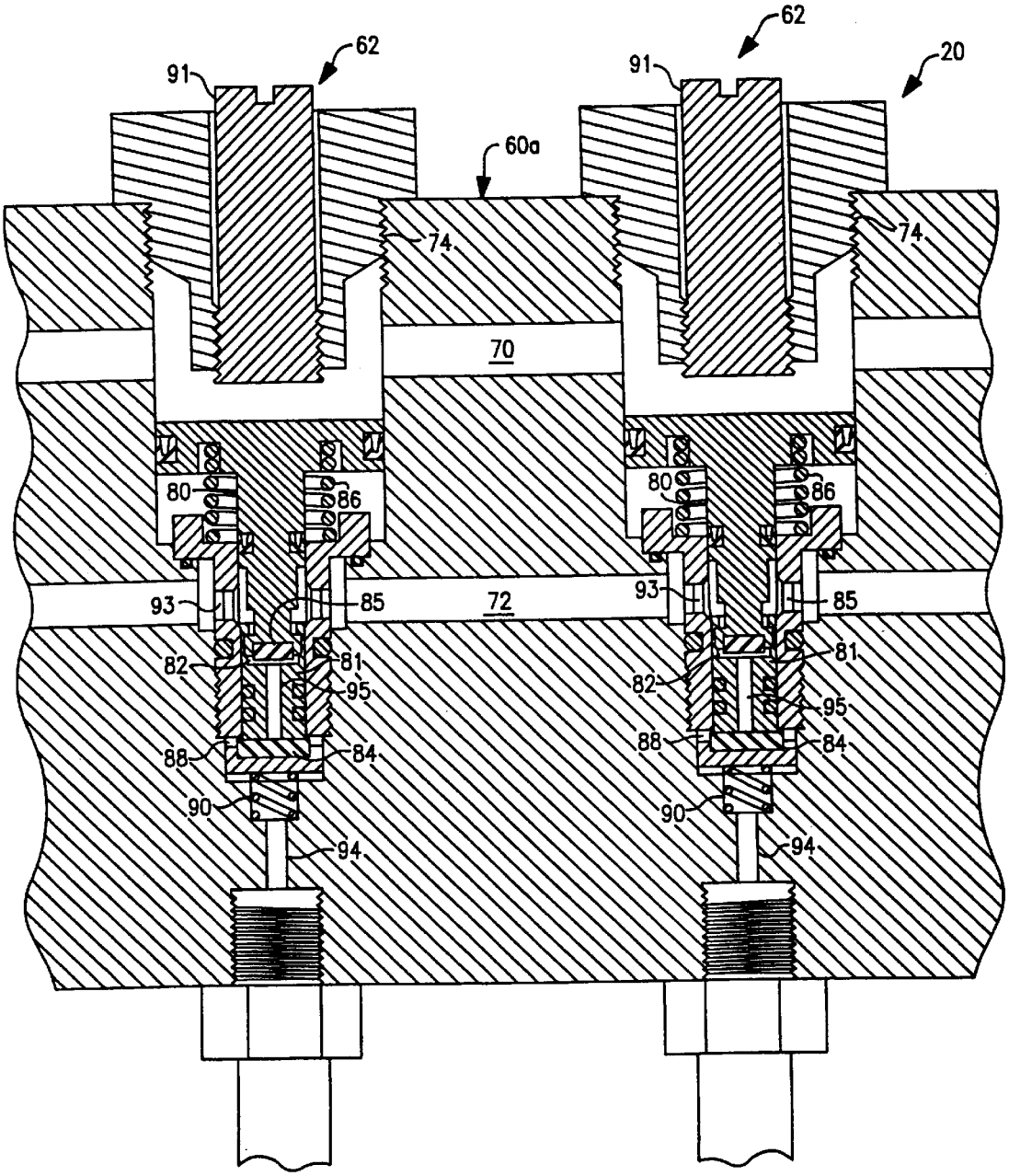
FIG. 5 is a partial cross-sectional view of the upper manifold and the pair of metering devices similar to FIG. 4, but after discharge of the predetermined amounts of coating material.

As best seen in FIGS. 4 and 5, upper manifold 60*a* has a pair of longitudinally extending passageways or bores 70 and 72. The upper passageway 70 is fluidly coupled at one end to operating system 22 for receiving pressurized fluid, such as air to operate upper metering devices 62 as discussed below. The opposite end of upper passageway 70 can be either closed off as illustrated in FIGS. 2, or fluidly coupled to lower manifold 60*b* to operate the lower metering devices 62. Lower passageway 72 is fluidly coupled at one end to the supply 24 of coating material. Similar to passageway 70, the opposite end of passageway 72 can be either closed off as illustrated in FIG. 2, or fluidly coupled to lower manifold 60*b* to supply coating material to lower metering devices 62. Upper manifold 60*a* is also provided with a plurality of transverse bores 74 for receiving upper metering devices 62. Bores 74 intersect with passageways 70 and 72 such that all of the metering devices 62 are simultaneously operated via operating system 22 and receive the coating material from supply 24.

In other words, it will be apparent to those skilled in the art that either a single source of pressurized air can be used to operate both the upper and lower metering devices 62, or a separate source of pressurized air can be utilized for the upper and lower metering devices 62. Likewise, either a single source of coating material can be used to supply both of the upper and lower metering devices 62, or a separate source of coating material can be utilized for the upper and lower metering devices 62.

Figure 7:
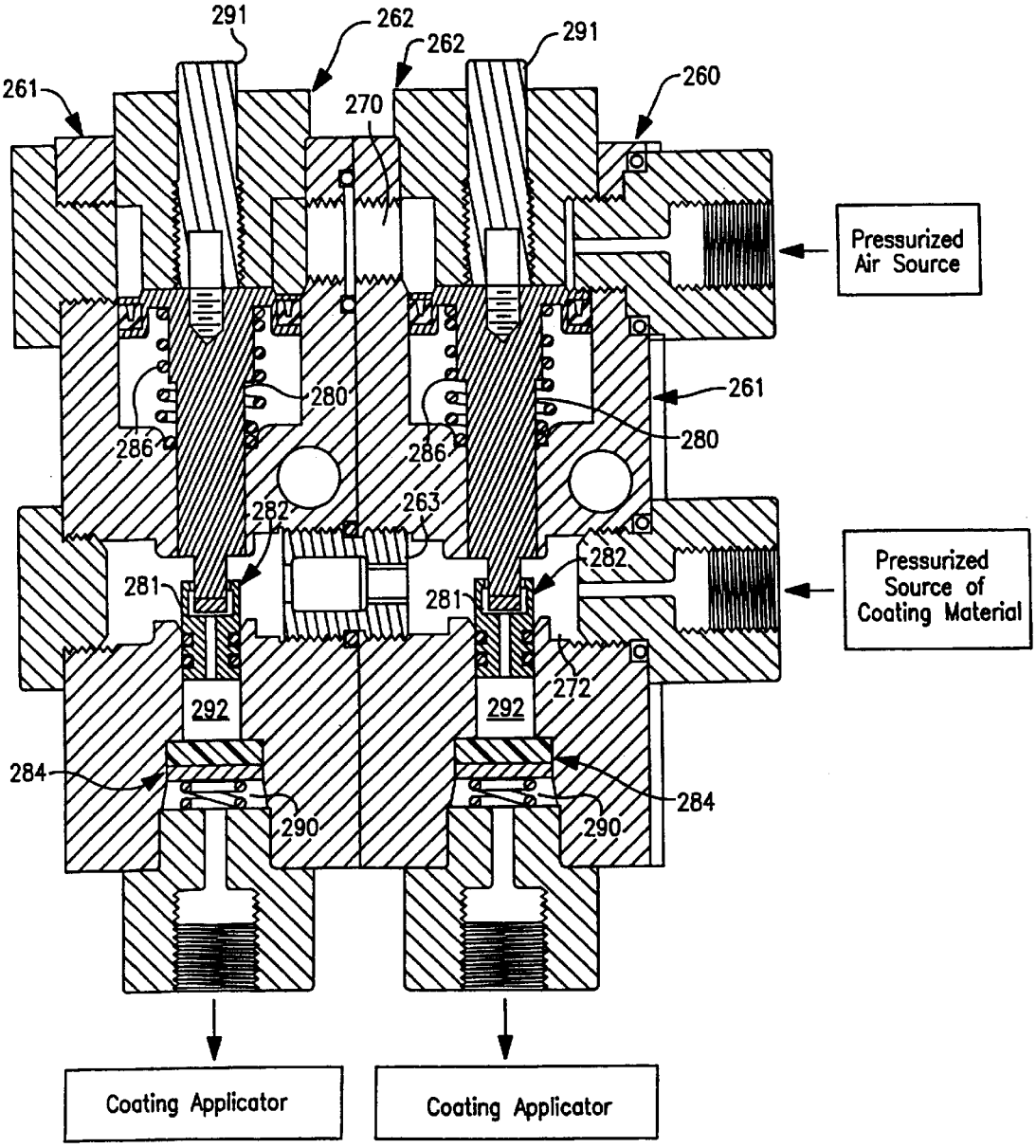
FIG. 7 is a partial cross-sectional view of a manifold and a pair of metering devices in accordance with an alternate embodiment, prior to discharging a predetermined amount of coating material.

While upper manifold 60*a* is shown as being a separate member from lower manifold 60*b*, it will be apparent to those skilled in the art that the two manifolds could be combined as a single unit if needed and/or desired. Moreover, it will be apparent to those skilled in the art that upper and lower manifolds 60*a* and 60*b* could also be constructed of a plurality of individual manifolds which could be coupled together in a modular design as seen in FIG. 7. Alternatively, a plurality of separate metering units could be used, with each unit having its own supply conduit for receiving air and its own supply conduit for receiving the coating material.

Upper and lower metering devices 62 are preferably metering devices which are manufactured by Oil-Rite Corporation of Wisconsin in accordance with U.S. Pat. No. 4,784,584 to Gruett, which issued on Nov. 15, 1988 and U.S. Pat. No. 4,784,578 to Gruett, which also issued on Nov. 15, 1988. Accordingly, U.S. Pat. Nos. 4,784,584 and 4,784,578 are hereby incorporated herein by reference to fully understand the workings of upper and lower metering devices 62 as they are adapted to be used in accordance with the present invention. Since the basic construction of upper and lower metering devices 62 are disclosed in the Gruett patents, which are incorporated herein by reference, the structure of upper and lower metering devices 62 will not be further discussed or illustrated in detail herein.

Each of the metering devices 62 is provided with an actuating piston 80 with a hollow metering piston 81 attached thereto that operates a sealing valve 82 and an evacuation or check valve 84. The piston 80 is normally biased upwardly by a compression spring 86 which opens sealing valve 82. In this open position, the outlet opening 88 for the coating material is closed by evacuation valve 84, which is normally biased to its closed position by a compression spring 90.

The piston 80 is air actuated via operating system 22 such that when the air pressure within the metering devices reach a certain predetermined level, piston 80 moves downwardly within the manifold to close the valve 82 and trap a predetermined amount of coating material in a chamber 92 which is positioned ahead of the pistons 80 and 81. This downward movement of piston 80 increases the pressure in the chamber 92, which in turn forces the evacuation valve 84 to open. When the evacuation valve 84 opens, a metered volume of liquid flows out of chamber 92 into a conduit 94 which is connected to one of the feed passageways 38 of one of the housings 34.

The size of chamber 92 can be selectively varied by adjusting set screw 91. Set screw 91 engages the rear surface of actuating piston 80 to adjust the dual piston arrangement for varying the amount of coating material to be dispensed in each stroke of piston 80. Thus, each of the metering devices 62 can be individually adjusted to ensure the proper amount of coating material is delivered to the fluid-wicking strips 36.

After the liquid exits the metering device, the pressure in chamber 92 of the metering device decreases and the force on the piston 80 is released to allow piston 80 to move upwardly within the manifold via spring 86. As the piston 80 moves up within manifold housing 60*a*, evacuation valve 84 closes and sealing valve 82 opens to allow liquid to flow into chamber 92 via central bore 95 of metering piston 81.

Operating system 22 as seen in FIGS. 1 and 2 include a pair of separate sources of compressed air 96*a* and 96*b*. However, it will be apparent to those skilled in the art from this disclosure that a single source of pressurized air can be utilized with a pair of conduits 97*a* and 97*b* extending therefrom to connect with the air passageway 70 in each of the manifolds 60*a* and 60*b*. The connections between conduits 97*a* and 97*b* and manifolds 60*a* and 60*b* are preferably accomplished in a conventional manner such as utilizing a threaded fitting type arrangement.

The pressurized air source from operating system 22 sends air pulses to metering devices 62. The pressure of the air pulses should be at least forty psi at each of the metering devices 62 to properly operate each of the metering devices 62.

Preferably, operating system 22 includes one or more hydraulic pumps to produce a pressure pulse to initiate a power or working stroke of piston 80. Initially, during the working stroke, piston 80 moves relative to piston 81 to close sealing valve 82. Once sealing valve 82 is closed, piston 80 and 81 move together as a single unit. When the pressure in the piston chamber 92 exceeds the biasing force of the spring 86, the evacuation or check valve 84 opens to allow the liquid medium or coating material in the piston chamber 92 to escape through outlet opening 88.

Figure 6:
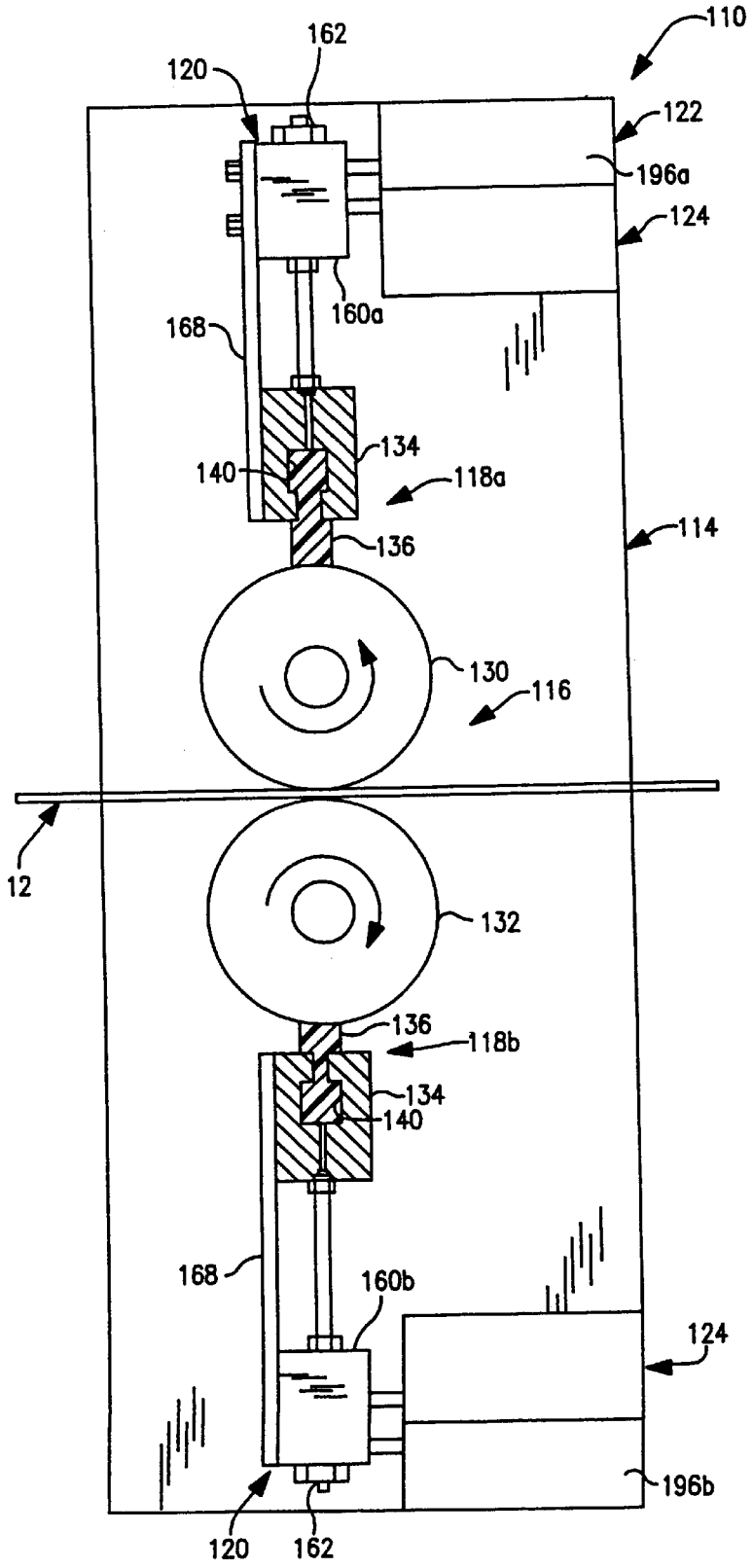
FIG. 6 is a diagrammatic side elevational view of a coating apparatus in accordance with a second embodiment of the present invention with certain parts removed and/or not shown for purposes of illustration.

During operation of the metering devices 62, the liquid medium or coating material being metered is fed through passageway 72 under pressure and provides a solid fill in the chambers 92 and 93 and bore 95 of piston 81 when the bore 95 is open. With the metering chamber 92 filled in the condition illustrated in FIG. 5, a burst or pulse of air pressure through the passageway 70 will drive the dual piston arrangement forwardly. Initially the actuating piston 80 will move relative to the metering piston 81 to engage the sealing block 85 of sealing valve 82 on the aft surface of the metering piston 81 to close the piston bore 95. Following the engagement between the pistons 80 and 81, they continue forwardly as a unit. When the pressure in the metering chamber 92 exceeds the biasing force of the spring 90, the check or evacuation valve 84 will open permitting passage of the liquid medium contents of the chamber toward the outlet 88. The power or working stroke of the two pistons 80 and 81 as a unit continues until the forwardly facing shoulder on the actuating piston 80 engages with the rearwardly facing end forming a fixed stop on the manifold 60*a*. When the actuating piston 80 engages with the fixed stop, the metering piston 81 will have broken the plane defined by manifold 60*a* as generally shown in FIG. 6.

After the liquid medium contents are forced from the chamber 92, the check or evacuation valve 84 will be biased against the forward face of the metering piston 81 to close the bore 95 and the spring 86 will start the return stroke of the actuating piston 80. Initially on the return stroke, the actuating piston 80 will move relative to the metering piston 81 until the shoulder of actuating piston 80 engages with the flanges of metering piston 81 to pick up and return the metering piston 81 and simultaneously open the rear end of the metering piston bore 95. Thereafter, the metering piston 81 and actuating piston 80 return as a unit while the metering chamber 92 is refilled in contemplation of the next working stroke of the dual piston arrangement.

In the illustrated embodiment, supply 24 of coating material is illustrated as two separate reservoirs 100*a* and 100*b* which are connected via conduits 99*a* and 99*b* to passageways 72 of manifolds 60*a* and 60*b*. Of course, it will be apparent to those skilled in the art from this disclosure that a single reservoir could be utilized with conduits 99*a* and 99*b* extending therefrom. Conduits 99*a* and 99*b* are preferably coupled to the reservoir and to the manifolds 60*a* and 60*b* via conventional fittings. Preferably, the coating material from the reservoir is supplied under pressure to ensure a positive flow. The pressure can be created by either a pump or a gravity feed type system as needed and/or desired.

Second Sub-Embodiment

Referring now to FIG. 6, a coating apparatus 110 in accordance with a second sub-embodiment of the present invention is illustrated. This embodiment is substantially identical to the first embodiment, except that applicators 118*a* and 118*b* are designed to apply a film of coating material to feed rolls 130 and 132 in the second sub-embodiment such that the feed rolls apply the thin film of coating material to the substrate 112. In view of the similarities between the first and second embodiments, the second sub-embodiment will be briefly discussed. Rather, the description of the first embodiment can be used understand the operation of coating apparatus 110. In fact, many of the parts are identical as seen in the attached drawings.

Basically, coating apparatus 110 includes a support or frame 114 having a sheet feeder 116 with feed rolls 130 and 132 coupled thereto and a pair of opposed coating applicators 118*a* and 118*b* for applying a film of coating material to feed rolls 130 and 132 which in turn applies a film of coating material to substrate 112. Similar to the first embodiment, coating applicators 118*a* and 118*b* have fluid-wicking strips 136 mounted in recesses 140 of housings 134.

Coating applicators 118*a* and 118*b* are fluidly coupled to metering system 120 which has a plurality of metering devices 162 for controlling the flow of coating material to applicators 118*a* and 118*b*. Pneumatic operating system 122 actuates the metering devices 162 for delivering predetermined amounts coating material from the supply or reservoir 124 of coating material.

Modified Manifold Housing

Referring now to FIG. 7, a modified manifold 260 is illustrated in which the metering units 262 are constructed in a modular manner. This embodiment allows for flexibility in designing the upper and lower manifolds, and can be used in either of the coating apparatuses 10 or 110, discussed above. In particular, due to the modular ability of this manifold 260, any number of metering units 262 can be coupled together for any particular application.

Metering units 262 operate in substantially the same manner as metering devices 62, discussed above. In view of the similarities between the metering units 262 and metering devices 62, the metering units 262 of this embodiment will only be briefly discussed to explain the differences. Each of the metering units 262 has a separate housing 261 which together with the other housings 261 form a manifold 260 with a continuous air passageway 270 and a continuous coating material passageway 272. Each of the housings 261 are fixedly coupled together by a fitting 263.

Similar to metering devices 62, metering units 262 are each have an actuating piston 280 with a hollow metering piston 281 attached thereto that operates a sealing valve 282 and an evacuation valve 284. The piston 280 is normally biased upwardly by a compression spring 286 which opens sealing valve 282. In this open position, the outlet opening 288 for the coating material is closed by evacuation valve 284, which is normally biased to its closed position by a compression spring 290. The size of piston chamber 292 can be selectively varied by adjusting set screw 291. Set screw 291 engages the rear surface of actuating piston 280 to adjust the dual piston arrangement for varying the amount of coating material to be dispensed in each stroke of piston 280. Accordingly, each of the metering units 262 can be individually adjusted to ensure the proper amount of coating material is delivered to fluid-wicking strips 36 or 236. Accordingly, metering units 262 operate in substantially the same manner as metering devices 62, discussed above.

Second Major Embodiment

A second major embodiment of the invention is adapted to coating the exterior surface of elongated material of constant cross-sectional size and shape. Examples of such material include pipe and tubing, with a circular cross section, and structural and/or decorative architectural materials (e.g., support beams, moldings, and the like), which may have almost any shape. In other words, the present invention can be utilized to coat materials other than sheet materials.

For such a use, a single fluid-wicking body or a group of fluid-wicking bodies are arranged to contact all parts of the exterior surface of a cross-section of the elongated material that are desired to be coated. Any means known in the art can be used to move the elongated material through a section of space in which such contact occurs between fluid-wicking body or bodies and the elongated material. Otherwise, operation according to this second embodiment is substantially the same as for the first sub-embodiment of the first major embodiment for coating both sides of a sheet or web material as described above.

Third Major Embodiment

In this embodiment, the present invention is designed for coating individual parts being processed on a conveyor line. The individual parts can have either a constant cross-sectional size and shape, or an irregular, non-uniform cross-sectional size and shape. In this embodiment, one or more fluid-wicking bodies are arranged in a coating station so as together to constitute the shape of the zone or zones of the individual part desired to be coated. As the conveyor line passes through the coating station, each part is temporarily brought into contact with the fluid-wicking body containing coating material absorbed therein, so as to transfer a desired amount of coating material to each desired coating zone of the individual part.

If desired, means can be used for temporarily displacing the individual part being coated from its line of progression along the conveyor and/or temporarily displacing the position in space of the fluid-wicking body with respect to the zone of progression of the individual parts along the conveyor line to provide a controlled compressive force between the zone(s) of the individual parts being coated and the fluid-wicking body or bodies. Moreover, a further means of controlling the amount of coating material applied can be provided for each zone.

While several embodiments have been chosen to illustrate the present invention, it will be understood by those skilled in the art that various changes and modifications can be made herein without departing from the scope of the invention as defined in the appended claims.

What is claimed is:

1. A method for applying a coating material on first and second zones of a substrate material, comprising the following steps of:

supplying a first coating material to a plurality of first metering devices;

supplying a second coating material to a plurality of second metering devices;

metering a predetermined amount of said first coating material from each of said first metering devices;

metering a predetermined amount of said second coating material from each of said second metering devices;

conveying said predetermined amount of said first coating material from each of said first metering devices to a plurality of spaced apart sections of a first elongated strip of fluid-wicking material such that a film of said first coating material is dispensed therefrom;

conveying said predetermined amount of said second coating material from each of said second metering devices to a plurality of spaced apart sections of a second elongated strip of fluid-wicking material such that a film of said second coating material is dispensed therefrom; and passing the substrate between said first and second strips of fluid-wicking material to apply said film of said first coating material to said first zone of said substrate material and said film of said second coating material to said second zone of said substrate material.

2. A method for applying a coating material on first and second zones of a substrate material according to claim 1, further comprising the step of:

pneumatically operating said first and second metering devices.

3. A method for applying a coating material on first and second zones of a substrate material according to claim 1, further comprising the step of:

independently adjusting said first and second metering devices to vary said predetermined amounts of said first and second coating materials being fed to each section of said first and second strips of fluid-wicking material.

4. A method for applying a coating material on first and second zones of a substrate material according to claim 1, wherein said first and second coating materials are the same.

5. A method for applying a coating material on first and second zones of a substrate material according to claim 1, wherein said first and second strips of fluid-wicking material contact said first and second zones of said substrate material to apply said film of said first coating material to a first zone of said substrate material and said film of said second coating material to a second zone of said substrate material.

6. A method for applying a coating material on first and second zones of a substrate material according to claim 1, wherein said first and second strips of fluid-wicking material contact first and second rolls which in turn contact said first and second zones of said substrate material to apply said film of said first coating material to said first zone of said substrate material and said film of said second coating material to said second zone of said substrate material.

7. A method for applying a coating material on first and second zones of a substrate material according to claim 1 wherein said first and second zones face in substantially opposite directions.

* * * * *